US007327214B2

(12) United States Patent
Tsukada

(10) Patent No.: US 7,327,214 B2
(45) Date of Patent: Feb. 5, 2008

(54) CHIP RESISTOR AND METHOD OF MAKING THE SAME

(75) Inventor: Torayuki Tsukada, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 11/526,975

(22) Filed: Sep. 26, 2006

(65) Prior Publication Data

US 2007/0018782 A1 Jan. 25, 2007

Related U.S. Application Data

(62) Division of application No. 10/833,939, filed on Apr. 27, 2004, now Pat. No. 7,129,814.

(30) Foreign Application Priority Data

Apr. 28, 2003 (JP) ..... 2003-123655

(51) Int. Cl.
*H01C 1/012* (2006.01)
*H01C 17/00* (2006.01)

(52) U.S. Cl. ..... 338/309; 29/610.1

(58) Field of Classification Search ..... 338/309; 29/610.1

See application file for complete search history.

(56) References Cited

U.S. PATENT DOCUMENTS 5,691,690 A 11/1997 Minato et al.
5,990,781 A 11/1999 Kambara
6,005,474 A 12/1999 Takeuchi et al.
6,127,722 A 10/2000 Doi et al.
6,703,683 B2 3/2004 Tanimura
2002/0031860 A1 3/2002 Tanimura
2006/0205171 A1 9/2006 Tsukada

FOREIGN PATENT DOCUMENTS

JP 6-45108 2/1994
JP 6-275401 9/1994
JP 10-189304 7/1998
JP 2001-176701 6/2001
JP 2002-57009 2/2002
JP 3848286 9/2006

OTHER PUBLICATIONS

Japanese Office Action from the corresponding JP2003-123655, dated Sep. 11, 2007.

*Primary Examiner*—Elvin Enad
*Assistant Examiner*—Joselito S. Baisa
(74) *Attorney, Agent, or Firm*—Hamre, Schumann, Mueller & Larson, P.C.

(57) ABSTRACT

A chip resistor includes a metal resistor element having a flat lower surface. The lower surface is formed with two electrodes spaced from each other, and an insulating resin film is formed between these electrodes. Each of the electrodes partially overlaps the insulating film so that a portion of the insulating film is inserted between each of the electrodes and the lower surface of the resistor element.

4 Claims, 7 Drawing Sheets

CHIP RESISTOR AND METHOD OF MAKING THE SAME

This application is a divisional of U.S. Ser. No. 10/833,939, filed Apr. 27, 2004 now U.S. Pat. No. 7,129,814, which application is incorporated herein by reference.

BACKGROUND OF THE INVENTION

1. Field of the Invention

The present invention relates to a chip resistor and a method of making the same.

2. Description of Related Art

An example of conventional chip resistors is illustrated in FIG. 8 of the present application (refer to JP-A-2002-57009). A chip resistor A1 includes a metal chip resistor element 100 which has a lower surface 100*a* formed with a pair of electrodes 110. Each of the electrodes 110 includes a lower surface formed with a solder layer 120. As understood from the figure, the lower surface 100*a* of the resistor element includes two areas each covered with the electrode 110 and an exposed area between the electrodes.

In use, the chip resistor A1 is soldered on a printed circuit board for example. It is desirable that molten solder sticks only to the two electrodes 110 of the chip resistor A1. However, according to the conventional structure shown in FIG. 8, molten solder may also stick to the above-described exposed area of the lower surface 100*a* of the resistor element. If the solder sticks to the lower surface 100*a*, the chip resistor A1 may exhibit a resistance which is different from an intended resistance, and an electric circuit using the chip resistor A1 may work improperly.

This problem can be solved by covering the above-described exposed area of the lower surface 100*a* of the resistor element with an insulating film made of resin, for example. However, if the insulating film is not sufficiently adherent to the metal resistor element 100, the insulating film may come off the resistor element 100 due to heat generation from the energized chip resistor A1 (or due to other factors).

DISCLOSURE OF THE INVENTION

The present invention has been conceived under the above-described circumstances. Therefore, it is an object of the present invention to provide a chip resistor including insulating films which hardly come off a resistor element. Another subject of the present invention is to provide a method of making such a chip resistor.

A chip resistor according to a first aspect of the present invention comprises a metal resistor element having a first principal surface and a second principal surface opposite the first principal surface, a first insulating film made of resin and formed on the first principal surface of the resistor element, and a film detachment regulator fixed to the resistor element. The film detachment regulator overlaps a portion of the first insulating film, whereby said portion of the first insulating film is inserted between the film detachment regulator and the first principal surface of the resistor element.

With the above-described structure, the film detachment regulator prevents the first insulating film from coming off the resistor element.

Preferably, the film detachment regulator comprises two main electrodes spaced from each other on the first principal surface, and the first insulating film is formed between the two main electrodes.

Preferably, the chip resistor further comprises a second insulating film made of resin and formed on the second principal surface of the resistor element. In this case, the film detachment regulator comprises two auxiliary electrodes spaced from each other on the second principal surface, and each of the auxiliary electrodes overlaps a portion of the second insulating film.

Preferably, the film detachment regulator further comprises a third insulating film formed on a side surface of the resistor element, and the third insulating film overlaps another portion of the first insulating film and another portion of the second insulating film.

Preferably, the first to third insulating films are made of a same material.

Preferably, the chip resistor further comprises a solder layer for covering each of the main and auxiliary electrodes.

Preferably, a spacing between the two auxiliary electrodes is larger than a spacing between the main electrodes.

Preferably, the main and auxiliary electrodes are made of a same material.

A second aspect of the present invention provides a chip resistor fabrication method. This method comprises the steps of: preparing a resistor bar including a first principal surface, a second principal surface opposite to the first principal surface, and two side surfaces extending between the first and second principal surfaces; forming a plurality of first insulating films spaced from each other on the first principal surface, while also forming a plurality of second insulating films spaced from each other on the second principal surface; forming a third insulating film on each of the two side surfaces, the third insulating film partially covering the first and second insulating films; forming a first conductive layer on areas of the first principal surface where the first insulating films are not formed, while also forming a second conductive layer on areas of the second principal surface where the second insulating films are not formed, the first conductive layer being greater in thickness than the first insulating films, the second conductive layer being greater in thickness than the second insulating films; and dividing the resistor bar into a plurality of resistor chips. The division of the resistor bar is performed in a manner such that each of the resistor chips is made to have electrodes originating from the first and second conductive layers.

Preferably, the first and second insulating films are formed by thick-film printing.

Preferably, the first and second conductive layers are formed by plating.

Preferably, the method of the present invention further comprises the step of performing barrel-plating to form a solder layer covering each of the electrodes on each resistor chip.

Other features and advantages of the present invention will be apparent from the following description of the preferred embodiments.

BEST MODE FOR CARRYING OUT THE INVENTION

A preferred embodiment of the present invention is specifically described below with reference to the accompanying drawings.

FIGS. 1 to 4 illustrate an example of a chip resistor according to the present invention. The illustrated chip resistor R1 includes a resistor element 1, a pair of main electrodes 21, a pair of auxiliary electrodes 22, first through third insulating films 31-33, and a pair of solder layers 4.

The resistor element 1 is a rectangular chip made of a metal and has a constant thickness as a whole. Examples of material include Ni—Cu alloy and Cu—Mn alloy. However, the material is not limitative on the present invention as long as the material has a resistivity suited to provide the chip resistor R1 with an intended resistance.

The pair of main electrodes 21 and the pair of auxiliary electrodes are made of the same material such as copper, for example. Each of the main electrodes 21 is formed on a lower surface 1*a* of the resistor element 1, while each of the auxiliary electrodes 22 is formed on an upper surface 1*b* of the resistor element 1. The paired main electrodes 21 are spaced from each other in a direction X, as also are the paired auxiliary electrodes 22.

Figure 3:
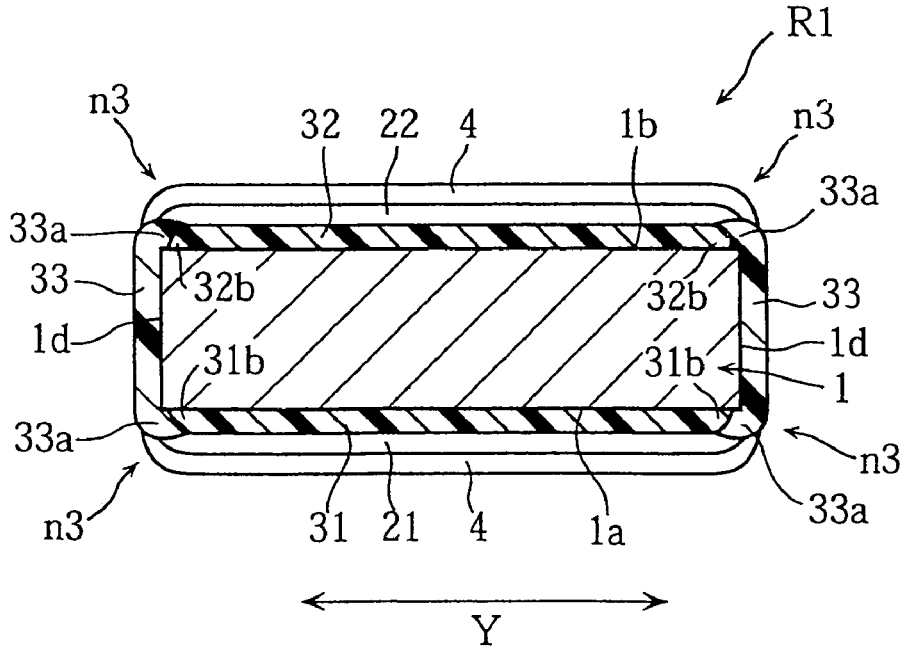
FIG. 3 is a sectional view taken along lines III-III in FIG. 1.

The first to third insulating films are made of epoxy resin or the like. The first insulating film 31 is formed on the lower surface 1*a* of the resistor element 1. Specifically, the lower surface 1*a* includes areas formed with the pair of main electrodes 21 and another area ("non-electrode area") without the electrodes. This non-electrode area is entirely covered by the first insulating film 31. In the illustrated embodiment, the first insulating film 31 is formed between the pair of main electrodes 21. Similarly, the second insulating film 32 entirely covers the non-electrode area of the upper surface 1*b* of the resistor element 1. The illustrated second insulating film 32 is formed between the pair of auxiliary electrodes 22. As shown in FIG. 3, the third insulating film 33 includes two insulating film portions, each of which entirely covers a respective side surface 1*d* of the resistor element 1.

Figure 2:
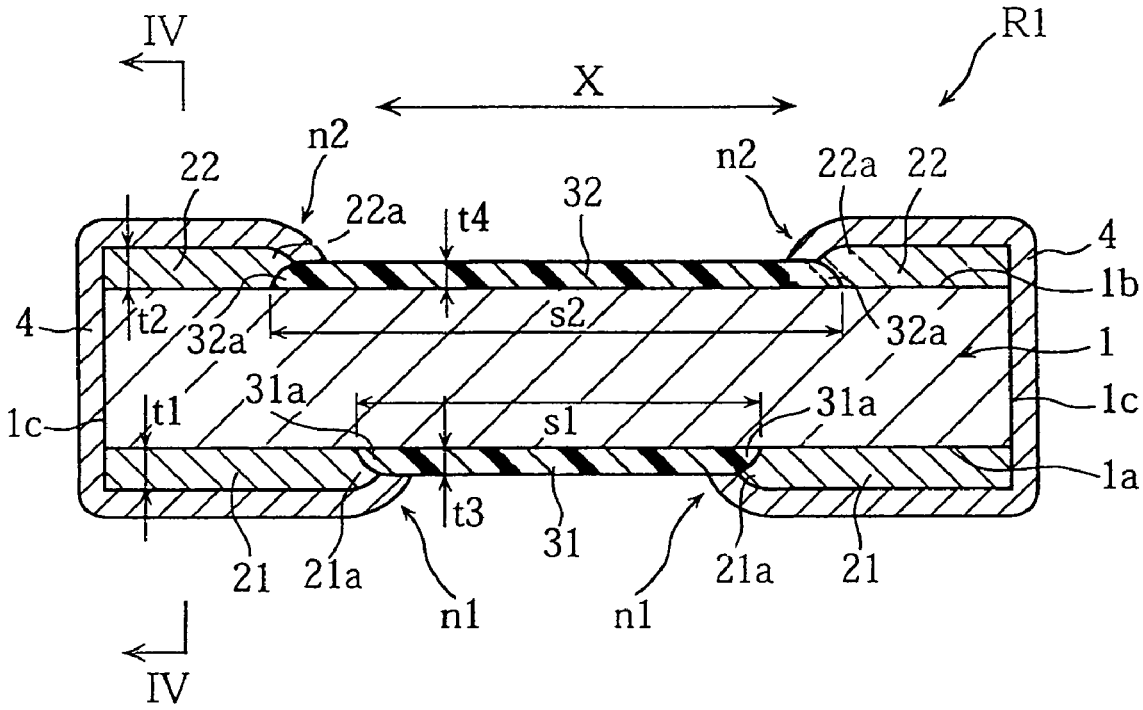
FIG. 2 is a sectional view taken along lines II-II in FIG. 1.

As indicated by reference sign n1 in FIG. 2, each of the main electrodes 21 includes an inner edge 21*a* which contacts and overlaps a respective end edge 31*a* of the first insulating film 31. (The first insulating film 31 includes two end edges 31*a* spaced in the direction X.) In other words, each end edge 31*a* of the first insulating film 31 is inserted between the inner edge 21*a* of a respective main electrode 21 and the lower surface 1*a* of the resistor element 1. Similarly, as indicated by reference sign n2, each of the auxiliary electrodes 22 includes an inner edge 22*a* which contacts and overlaps a respective end edge 32*a* of the second insulating film 32. (The second insulating film 32 includes two end edges 32*a* spaced in the direction X.) In other words, each end edge 32*a* of the second insulating film 32 is inserted between the inner edge 22*a* of a respective auxiliary electrode 22 and the upper surface 1*b* of the resistor element 1.

The above-described overlapping state of the electrodes 21, 22 may be provided by forming these electrodes through plating, as described below. The thicknesses t1, t2 of the main electrodes 21 and the auxiliary electrodes 22 are larger than the thicknesses t3, t4 of the first and second insulating films.

The spacing s1 between the pair of main electrodes 21 is determined by the first insulating film 31 formed therebetween and is equal to the width to the first insulating film 31, as described below. As shown in FIG. 2, the spacing s1 between the main electrodes 21 refers to the spacing between the inner edges of the main electrodes 21 that contact the lower surface 1*a* of the resistor element 1.

Similarly, the spacing s2 between the pair of auxiliary electrodes 22 is determined by the second insulating film 32 formed therebetween and is equal the width of the second insulating film 32. In the illustrated example, the spacing s2 between the auxiliary electrodes is greater than the spacing s1 between the main electrodes, but this is not limitative on the present invention. For example, the spacings s1, s2 may be equal to each other.

As indicated by reference sign n3 in FIG. 3, each of the insulating films 33 includes a lower edge 33*a* that extends over a respective side surface 1*d* of the resistor element 1 onto the lower surface 1*a* of the resistor element 1 for overlapping contact with a respective side edge 31*b* of the first insulating film 31. (In other words, each side edge 31*b* of the first insulating film 31 is inserted between the lower edge 33*a* of the third insulating film 33 and the lower surface 1*a* of the resistor element 1.) Similarly, each of the third insulating films 33 also includes an upper edge 33*a* that extends over a respective side surface 1*d* of the resistor element 1 onto the upper surface 1*b* of the resistor element 1 for overlapping contact with a respective side edge 32*b* of the second insulating film 32. Such overlapping may be provided by forming the third insulating film 33 through a dip process, as described below.

Figure 4:
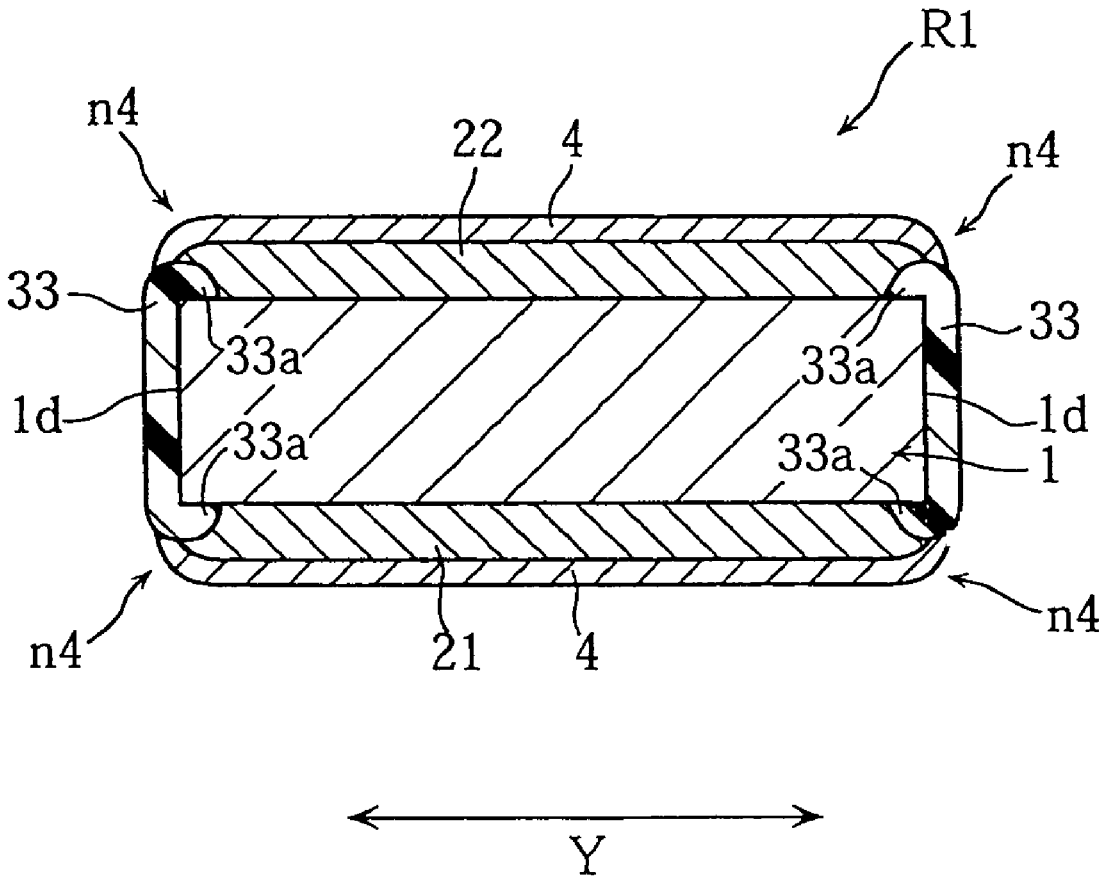
FIG. 4 is a sectional view taken along lines IV-IV in FIG. 2.

FIG. 4 illustrates a section of the chip resistor R1 taken along lines IV-IV in FIG. 2. As indicated by reference sign n4 in the figure, the lower edge 33*a* of the third insulating film 33 is held in overlapping contact with the main electrode 21. Similarly, the upper edge 33*a* of the third insulating film 33 is held in overlapping contact with the auxiliary electrode 22.

As shown in FIG. 2, each of the solder layers 4 covers a respective end face 1*c* of the resistor element 1, a respective main electrode 21, and a respective auxiliary electrode 22. Like the main electrodes 21 and the auxiliary electrodes 22, the solder layers 4 overlap the first to third insulating films 31-33.

In the illustrated embodiment, the resistor element 1 has a thickness of about 0.1-1.0 mm. Each of the main electrodes 21 and the auxiliary electrodes 22 has a thickness of about 30-100 μm, whereas each of the first to third insulating films 31-33 has a thickness of about 20 μm. Each of the solder layers 4 has a thickness of about 5 μm. The length and width, respectively, of the resistor element 1 may be about 2-7 mm. The chip resistor R1 has a small resistance of e.g. about 0.5-10Ω. Of course, these values are only exemplary and does not limit the scope of the present invention.

Next, a method of making chip resistors R1 will be described with reference to FIGS. 5-7.

Figure 5A:
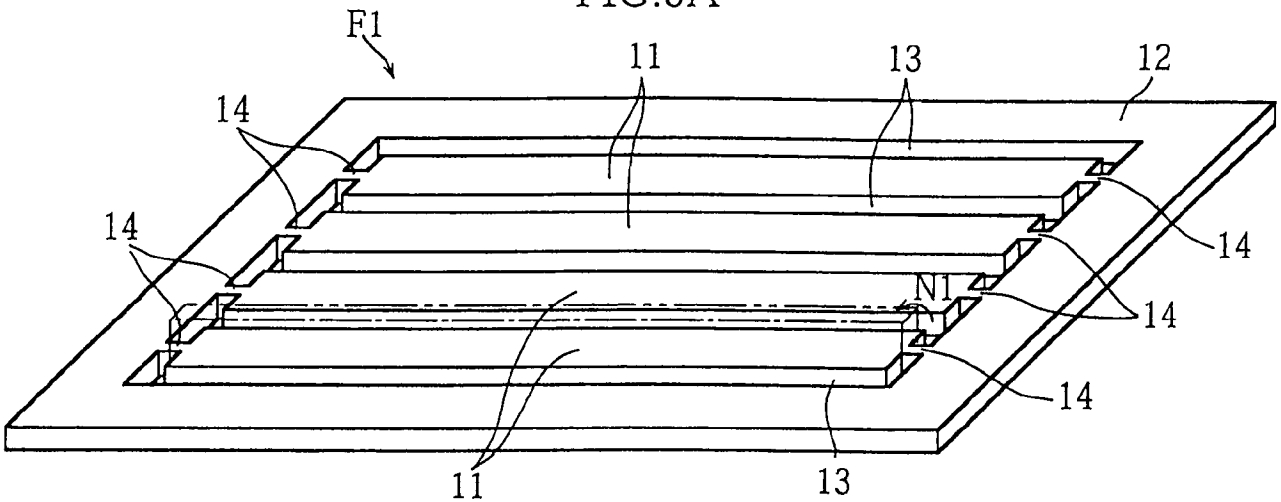
FIG. 5A is a perspective view illustrating a frame for making the chip resistor of the present invention.
Figure 5B:
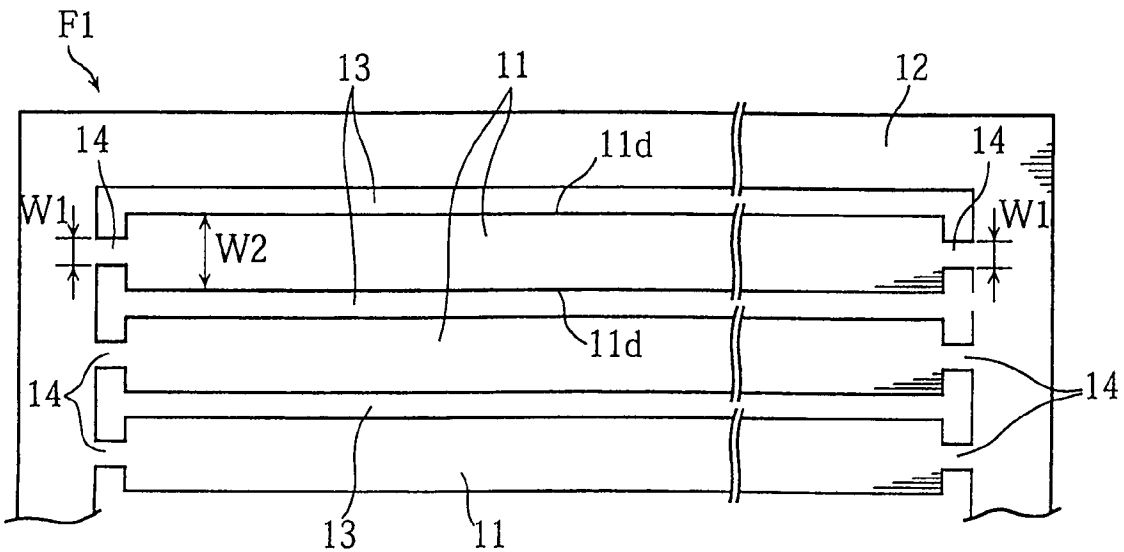
FIG. 5B is a plan view illustrating a principal portion of the frame.

First, as shown in FIGS. 5A and 5B, a frame F1 is prepared as a material for making resistor elements 1. The frame F1 can be formed by punching a metal plate which has a constant thickness as a whole. The frame 1 includes a plurality of strips 11 extending in a predetermined direction and a rectangular supporting portion 12 for supporting the plurality of strips 11 via connecting portions 14. Each of the strips 11 is flanked by slits 13. Each of the connecting portions 14 has a width W1 that is smaller than the width W2 of each strip 11.

Figure 6A:
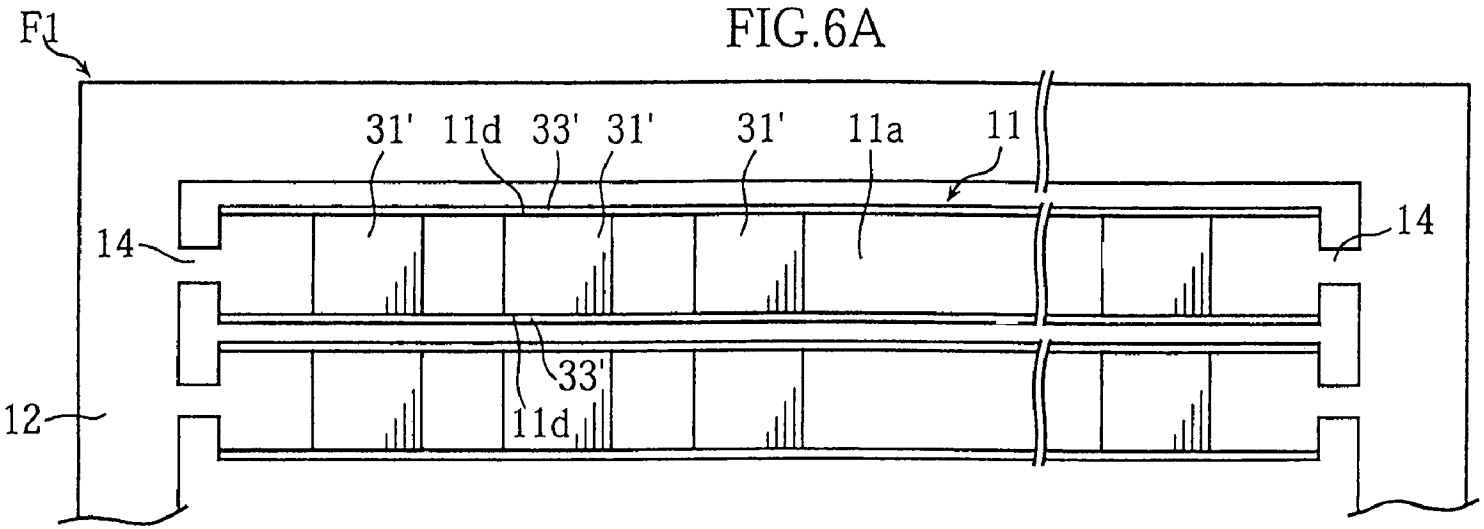
FIGS. 6A and 6B are plan views illustrating a method step of making the chip resistor using the frame.
Figure 6B:
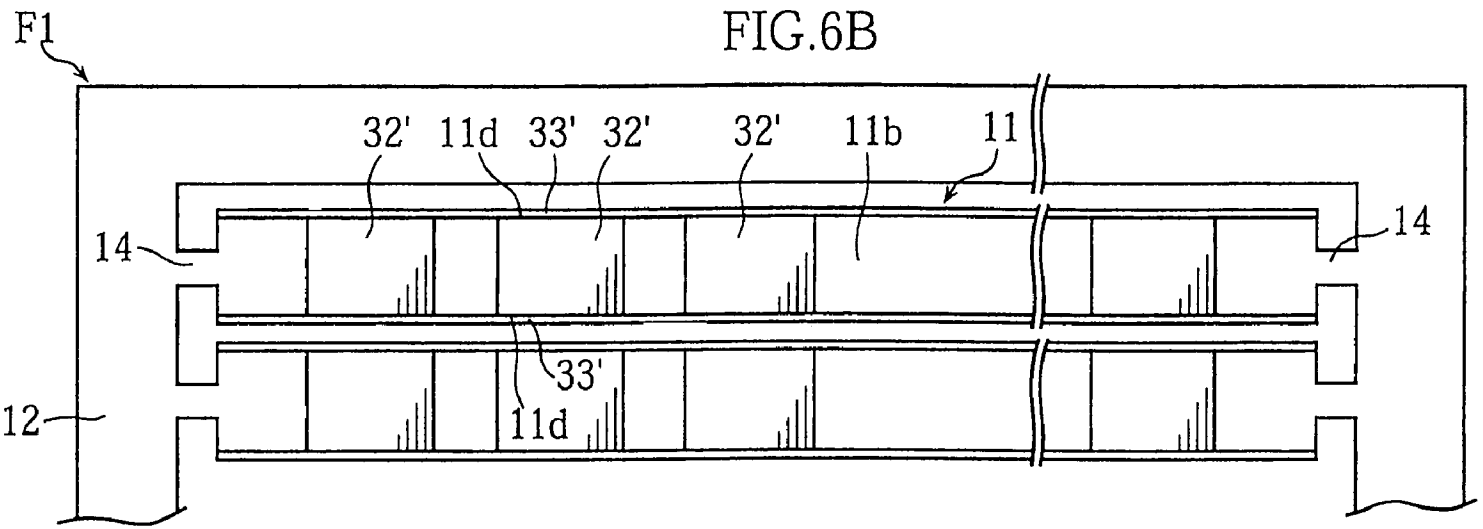

Then, as shown in FIG. 6A, a plurality of rectangular first insulating films 31' are formed on a first surface 11*a* of each strip 11. These first insulating films 31' are spaced from each other longitudinally of the strip 11. Similarly, as shown in FIG. 6B, a plurality of rectangular second insulating films 32' are formed on a second surface 11*b* (opposite to the first surface 11*a*) of each strip 11. These second insulating films 32' are similarly spaced from each other longitudinally of the strip 11. The formation of the first and second insulating films 31', 32' may be performed by thick-film printing using e.g. a same epoxy resin. Such thick-film printing causes each of the first and second insulating films 31', 32' to have a precise width and thickness as intended.

Next, each of the connecting portions 14 are twisted to rotate a respective strip 11 through 90 degrees relative to the supporting portion 12 (refer to an arrow N1 and chain lines in FIG. 5). The strip 11 can be easily rotated since the width W1 of the connecting portion 14 is smaller than the width W2 of the strip 11, as described above. After the 90-degree rotation of the strip 11, a third insulating film 33' is formed on each of a pair of side surfaces 11*d* of the strip 11 by dipping. Specifically, each of the longitudinally extending side edges of the strip 11 is dipped in a coating liquid for forming an insulating film. In this step, the liquid is also coated on the edges of the first and second insulating films 31', 32', in addition to the side surfaces 11*d* of the strips 11. After the coating step, the liquid is cured to appropriately form the third insulating film 33' for covering the edges of the first and second insulating films 31', 32'. When the third insulating film 33' is formed, the strip 11 is reversely rotated to the initial position.

Figure 7A:
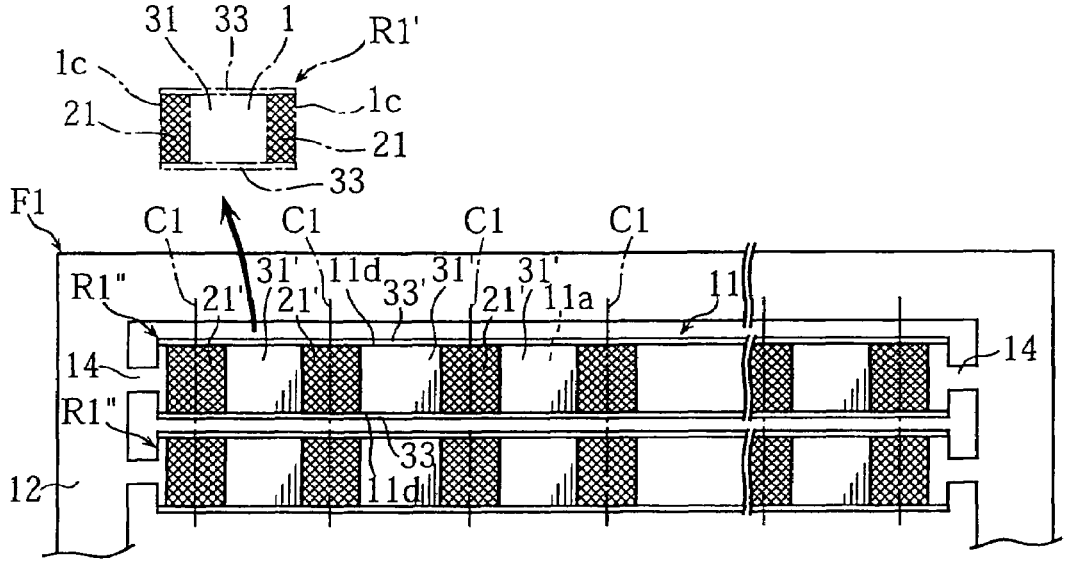
FIGS. 7A and 7B are plan views illustrating a method step following the method step shown in FIGS. 6A and 6B.
Figure 7B:
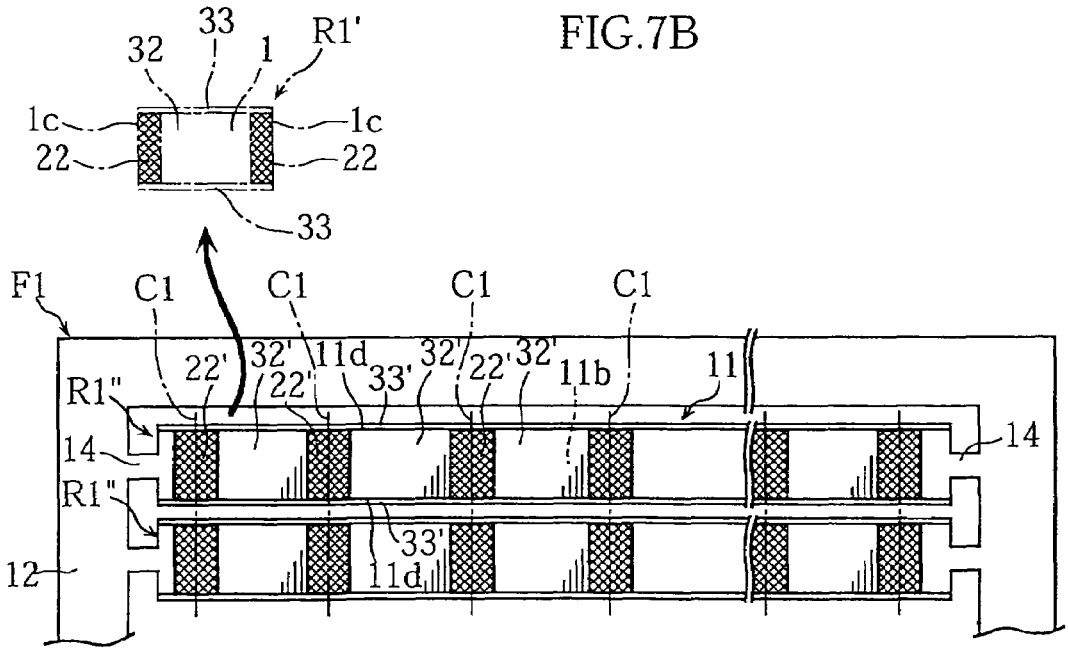
Figure 8:
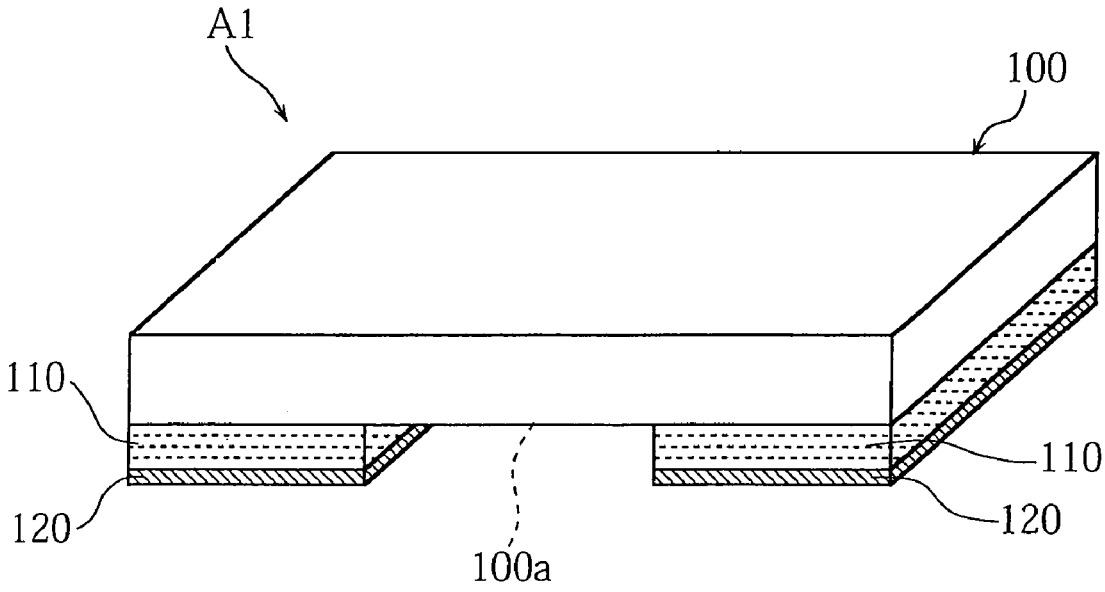
FIG.8 PRIOR ART
FIG. 8 is a perspective view illustrating a conventional chip resistor.

Then, as shown in FIG. 7A, the first surface 11*a* of each strip 11 is formed with conductive layers 21' (represented by criss-cross hatching) at areas where the first insulating films 31' are not formed. The conductive layers 21' serve as the main electrodes 21. Similarly, as shown in FIG. 7B, the second surface 11*b* of the strip 11 is formed with conductive layers 22' (represented by criss-cross hatching) at areas where the second insulating films 32' are not formed. The conductive layers 22' serve as the auxiliary electrodes 22.

The conductive layers 21', 22' may be formed by e.g. copper-plating. Due to the plating process, the conductive layers 21', 22' can be formed simultaneously on the two surfaces of each strip 11. Further, the conductive layers 21', 22' can be formed thicker than the first to third insulating films 31'-33' by the plating process so that the conductive layers 21', 22' partially cover the edges of the first to third insulating films 31'-33'.

Due to the above-described method step, bar-shaped resistor aggregates R1" are produced. Each resistor aggregate R1" is cut at the positions of phantom lines C1 to obtain a plurality of chip resistors R1' which are not formed with solder layers. Each of the cutting lines is located at such a position as to halve a respective one of the conductive layers 21', 22' widthwise thereof. As a result, each of the chip resistors R1' is made to have two pairs of electrodes originating from the conductive layers 21', 22'.

Finally, a solder layer 4*a* is formed to cover each end face 1*c* of the resistor element 1 of each chip resistor R1', the surface of each main electrode 21 and the surface of each auxiliary electrode 22. The solder layer 4 may be formed by barrel-plating, for example. In the barrel-plating, a plurality of chip resistors R1' are placed in a single barrel. In each chip resistor R1', each end face 1*c* of the resistor element 1, the surface of each main electrode 21 and the surface of each auxiliary electrode 22 are exposed to provide exposed metallic surfaces, whereas the other surfaces are covered by the first to third insulating films 31-33. Due to this structure, the solder layers 4 are efficiently and appropriately formed only over the above-described metallic surfaces.

The chip resistor R1 illustrated in FIGS. 1-4 is efficiently produced in the above-described series of process steps.

The chip resistor R1 may be surface-mounted on a desired target mount (e.g. circuit board) by reflow soldering, for example. In the reflow soldering, a solder paste is applied onto terminals of the target mount before the main electrodes 21 of the chip resistor R1 are placed on the terminals via the solder layers 4. The chip resistor R1 placed on the target mount is heated in a reflow furnace. The chip resistor R1 is subsequently fixed to the target mount upon cooling for solidification of melted solder. As shown in FIG. 2, the main electrodes 21 project downwardly beyond the first insulating film 31. Due to this structure, the main electrodes 21 are reliably soldered onto the target mount.

The solder layers 4 are melted during the reflow soldering. Since the solder layers 4 are formed on the end faces 1*c* of the resistor element 1 as well as on the surfaces of the main electrodes 21 and auxiliary electrodes 22, solder fillets Hf are formed, as indicated by phantom lines of FIG. 1. The state (e.g. shape) of the solder fillets Hf may be checked from outside for easily determining whether the mounting of the chip resistor R1 is appropriate. Further, the solder fillets facilitate reliable mounting of the chip resistor R1 while regulating a temperature rise of the chip resistor R1 upon passage of a current.

In surface-mounting of the chip resistor R1, solder may flow beyond the surfaces of the main electrodes 21 and auxiliary electrodes 22. The insulating films 31, 32 are formed on the lower surface 1*a* and upper surface 1*b* of the resistor element 1. Further, the third insulating films 33 are formed on the side surfaces 1*d*. Due to this structure, melted solder is prevented from sticking to the resistor element 1, thereby avoiding a deviation from the given resistance of the chip resistor R1.

Figure 1:
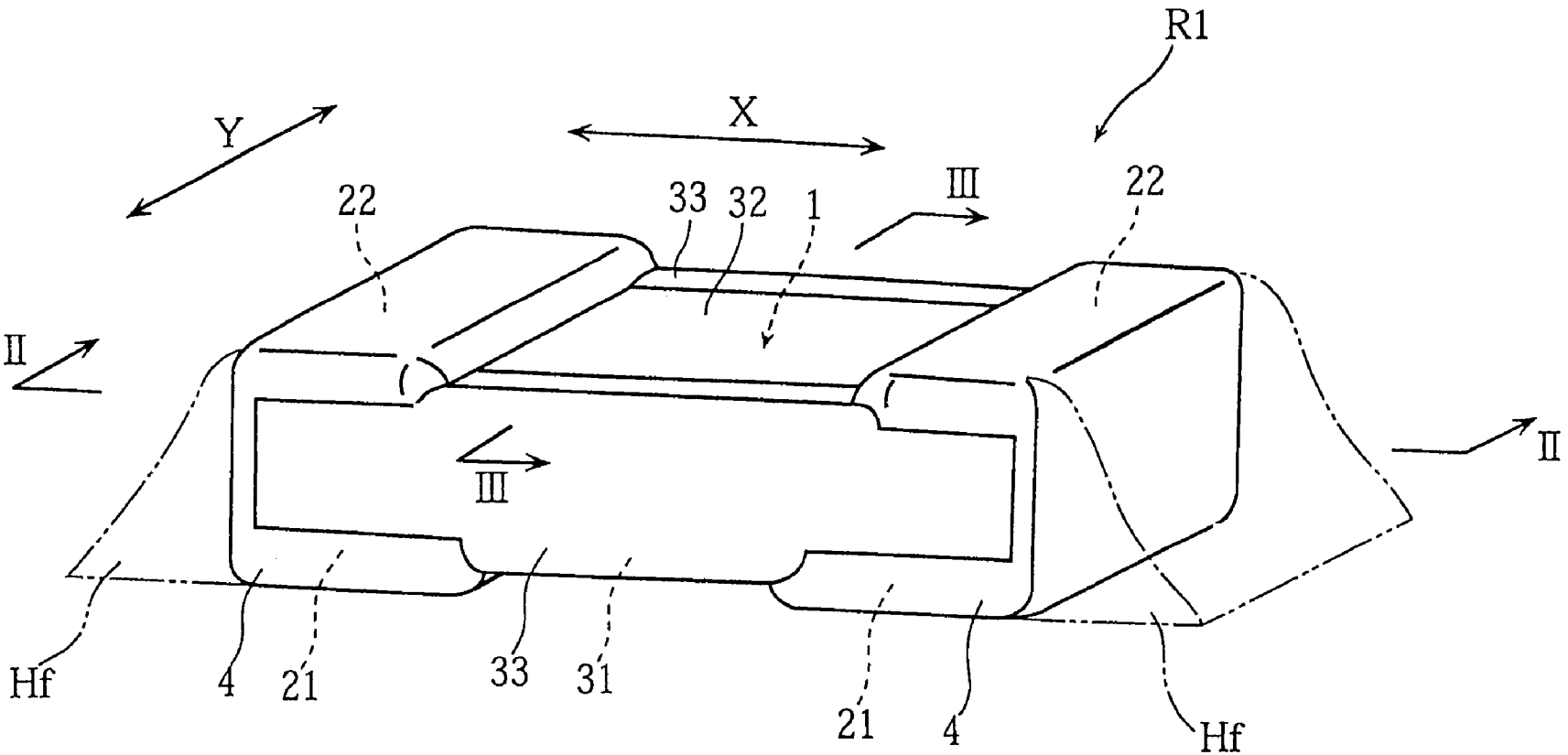
FIG. 1 is a perspective view illustrating a chip resistor according to the present invention.

As shown in FIG. 2, the end edges 31*a* of the first insulating film 31 are covered by the inner edges 22*a* of the main electrodes 21, whereas the end edges 32*a* of the second insulating film 32 of the chip resistor R1 are covered by the inner edges 22*a* of the auxiliary electrodes 22. Further, as shown in FIG. 3, the side edges 31*b* of the first insulating film 31 are covered by the lower edges 33*a* of the third insulating films 33, whereas the side edges 32*b* of the second insulating film 32 are covered by the upper edges 33*a* of the third insulating films 33. Due to this structure, even if the chip resistor R1 generates heat upon passage of a current, the insulating films 31, 32 are prevented from coming off the resistor element 1. On the other hand, as shown in FIG. 1, the third insulating films 33 are partially covered by the main electrodes 21 and the auxiliary electrodes 22. Due to this structure, the third insulating films 33 are prevented from coming off the resistor element 1.

In order for the chip resistor R1 to have an intended target resistance (resistance between the pair of main electrodes 21), it is necessary to accurately set spacing s1 between the pair of main electrodes 21 at a predetermined value. In this regard, the spacing s1 between the pair of main electrodes 21 is determined by the first insulating film 31 whose size can be precisely set by thick-film printing. Thus, it is possible to precisely set the spacing s1 at a determined value.

According to the present invention, the number of electrodes formed on the resistor element may be optionally selected depending on the application of the chip resistor. It is possible to form two or more pairs of electrodes, and a selected pair or pairs may be utilized depending on the application. In the case where two pairs of electrodes are formed, one pair of electrodes may be used to detect an electric current while the other pair of electrodes may be used for voltage detection.

Further, according to the present invention, the auxiliary electrodes 22 need not be formed. In the case where the auxiliary electrode is omitted, the second insulating film 32 may be made to entirely cover the upper surface of the resistor element 1. In this case, the second insulating film 32 can be prevented from coming off by covering the side edges of the insulating film 32 by the third insulating films 33.

Still further, according to the present invention, only either one of the first and second insulating films 31, 32 may be formed.

Regarding the process for making a chip resistor of the present invention, the above-described frame F1 may be replaced by a solid blank plate as a resistor material. In this case, the solid resistor material plate is formed with first and second insulating films respectively on one surface and the opposite surface, before being divided into bars. Thereafter, each of the resistor material bars is formed with a third insulating film on each of its side surfaces.

The present invention being thus described, it is obvious that the same may be modified in various ways. Such modifications should not be regarded as a departure from the spirit and scope of the invention, and all such modifications as would be obvious to those skilled in the art are intended to be included in the scope of the appended claims.

The invention claimed is:

1. A chip resistor fabrication process comprising the steps of:

preparing a resistor bar including a first principal surface, a second principal surface opposite to the first principal surface, and two side surfaces extending between the first and second principal surfaces;

forming a plurality of first insulating films spaced from each other on the first principal surface, while also forming a plurality of second insulating films spaced from each other on the second principal surface;

forming a third insulating film on each of the two side surfaces, the third insulating film partially covering the first and second insulating films;

forming a first conductive layer on areas of the first principal surface where the first insulating films are not formed, while also forming a second conductive layer on areas of the second principal surface where the second insulating films are not formed, the first conductive layer being greater in thickness than the first insulating films, the second conductive layer being greater in thickness than the second insulating films; and dividing the resistor bar into a plurality of resistor chips;

wherein the division of the resistor bar is performed in a manner such that each of the resistor chips is made to have electrodes originating from the first and second conductive layers.

2. The chip resistor fabrication process according to claim 1, wherein the first and second insulating films are formed by thick-film printing.

3. The chip resistor fabrication process according to claim 1, wherein the first and second conductive layers are formed by plating.

4. The chip resistor fabrication process according to claim 1, further comprising the step of performing barrel-plating to form a solder layer covering each of the electrodes on each resistor chip.

* * * * *